US006436125B1

(12) United States Patent
Rhoads

(10) Patent No.: US 6,436,125 B1
(45) Date of Patent: Aug. 20, 2002

(54) DOUBLE-SIDED BABY PACIFIER

(76) Inventor: Eliza M. Rhoads, P.O. Box 327, Belle, MO (US) 65013

( * ) Notice: Subject to any disclaimer, the term of this patent is extended or adjusted under 35 U.S.C. 154(b) by 0 days.

(21) Appl. No.: 09/565,048

(22) Filed: May 5, 2000

(51) Int. Cl.[7] ..... A61J 17/00
(52) U.S. Cl. ..... 606/234
(58) Field of Search ..... 606/236, 234, 606/235, 1; 215/11.1, 11.3, 11.4, 11.5; D24/194, 195, 196

(56) References Cited

U.S. PATENT DOCUMENTS 4,488,551 A * 12/1984 Connelly ..... 606/236
5,843,128 A * 12/1998 Wexler ..... 606/234
D430,300 S * 8/2000 Anthony, Jr. ..... D24/194

* cited by examiner

*Primary Examiner*—Kevin Truong
(74) *Attorney, Agent, or Firm*—Henry W. Cummings

(57) ABSTRACT

A pacifier is provided having two teat sucking portions integrally connected to a middle support member. Each of the teat sucking portion includes a shank portion and a nipple portion adapted to be sucked by the child. The support member may become either convex or concave depending upon the side of the pacifier in which suction is applied. The middle support member must have sufficient flexibility to allow this movement between neutral, convex and concave positions. The pacifier is made of elastomeric material such as natural or synthetic rubber. Preferably, air holes are provided in the center support section. These holes are preferably aligned horizontally and are aligned to the baby's mouth to facilitate airflow passage. The air holes also create more flexibility in the middle support member to allow movement between neutral, convex and concave positions.

6 Claims, 4 Drawing Sheets

DOUBLE-SIDED BABY PACIFIER

I. FIELD OF THE INVENTION

This invention relates to baby pacifiers.

II. BACKGROUND OF THE INVENTION

In U.S. Pat. No. 1,268,470 (1918), discloses a multi-sided device for teething of infants but it does not indicate it could be used as a pacifier.

In U.S. Design Pat. No. 200,618 (1965), a design patent having multiple teats is disclosed for a baby pacifier.

In U.S. Design Pat. No. 279,218 (1985), a baby pacifier is disclosed with multiple teats including a pair of resilient rings surrounding portions of the multiple teats.

In U.S. Pat. No. 4,577,632 (1986), a combination pacifier and teething ring is disclosed. However, dual teats are not disclosed.

In U.S. Pat. No. 1,656,833 (1928), and U.S. Pat. No. 4,481,949 (1984) disclose pacifiers having a rigid guard to protect teat made of rigid material such as bone or metal.

In U.S. Pat. No. 4,324,249(1982), a pacifier is disclosed having a single teat and a rigid plastic protecting disk but only a single teat is disclosed.

In U.S. Pat. No. 4,447,164(1984), a pacifier is disclosed in which a teat is made of transparent material and a liquid crystal is provided in the teat which will have a color change if the baby's temperature is abnormal.

These references are hereby incorporated into the present application by this reference.

III. SUMMARY OF THE INVENTION

A. Objects of the Invention

One object of the present invention is to provide a pacifier, which will enable the child easily to locate the teat area of the pacifier.

Another object of the present invention is to avoid frustration of the child when the child is unable to properly locate the teat for sucking.

Another object of the present invention is to avoid the child sucking on the pacifier backwards.

Another object of the present invention is increase safety of drivers travelling with children in vehicles by having to concentrate on a frustrated child rather than the road and traffic.

Another object of the present invention is to avoid the problem of passengers and drivers in vehicles having to unbuckle their seat-belts and insert the pacifier into the child's mouth while driving.

Another object of the present invention is to provide a pacifier support for a two-nipple pacifier, which can become either convex or concave depending upon the side that the child is sucking.

Another object of the present invention is to increase the flexibility of the middle support in movement back and forth, from one side to the other side in the pacifier.

Another object of the present invention is to provide ease of airflow in the pacifier.

B. Summary

In accordance with the present invention, a pacifier is provided having two teat sucking portions integrally connected to a middle support member. Each of the teat sucking portions includes a shank portion and a nipple portion adapted to be sucked by the child. The support member may move from a neutral position and become either convex or concave depending upon the side of the pacifier in which suction is applied. The middle support member must have sufficient flexibility to allow this movement between convex and concave positions. The pacifier is made of elastomeric material such as natural or synthetic rubber. Preferably, air holes are provided in the center support section. These holes are preferably aligned horizontally and are aligned to the baby's mouth to facilitate airflow passage. The air holes also create more flexibility in the middle support member to allow movement from the convex to concave position when suction has been applied.

IV THE DRAWINGS

VI DESCRIPTION OF PREFERRED EMBODIMENTS

Figure 1:
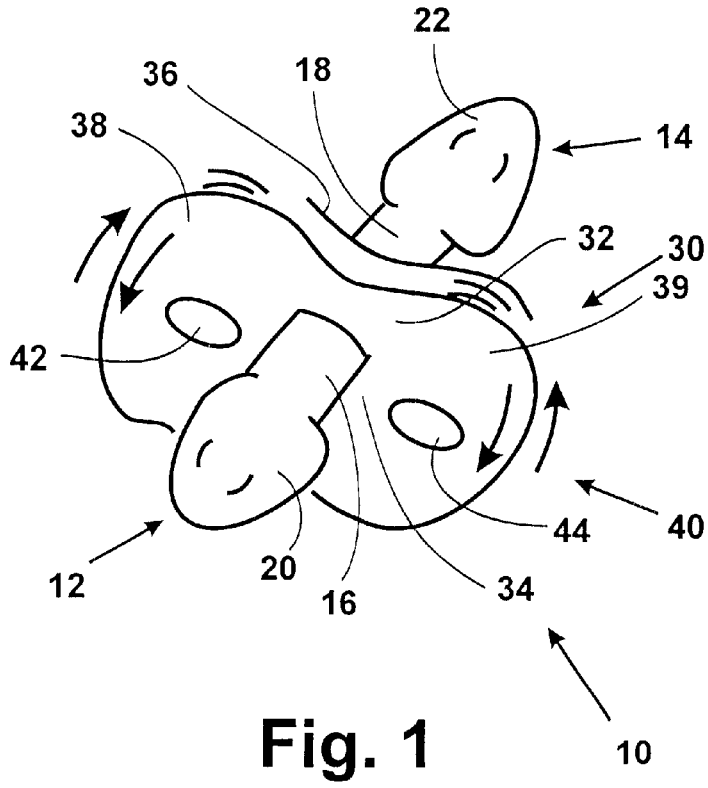
FIG. 1 is a schematic perspective view of the dual nipple pacifier of the present invention.
Figure 1A:
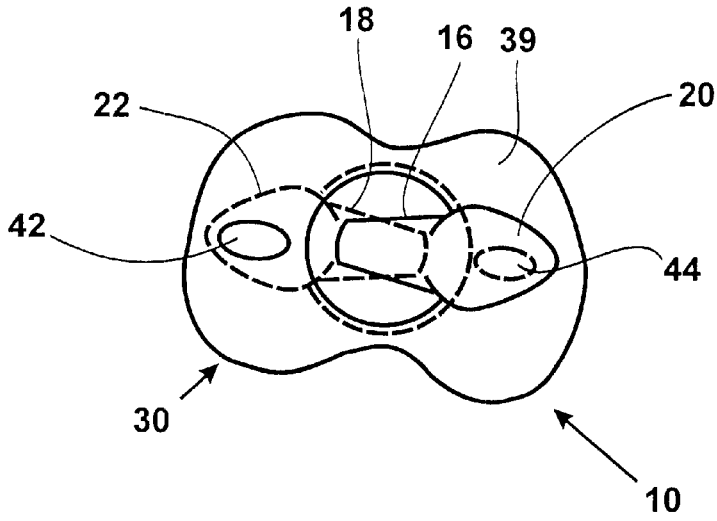
FIG. 1A is a front view of FIG. 1.

The pacifier of the present invention is indicated in the drawings generally at 10.

The pacifier includes a pair of sucking portions, 12 and 14, which are laterally spaced. The sucking portions include respective shank portions, 16 and 18, and nipple portions, 20 and 22.

Each of the shank portions, 16 and 18, are respectively integrally connected to a middle support member, 30.

The middle support member must have sufficient flexibility to allow this movement between convex and concave positions. Preferably, the sucking portions, 12 and 14, and the middle portion, 30 are made of elastomeric material such as natural or synthetic rubber. Preferably, the entire assembly is molded into one piece.

The middle support portion, 30, includes a body portion, 32, to which shank portions 16 and 18 are integrally connected on respective opposite faces, 34 and 36. The middle portion further includes outwardly extending ear portions, 38 and 39, on each of the faces, 34 and 36.

Means for facilitating airflow are also provided in the middle support member indicated generally at 40 including laterally spaced openings, 42 and 44. Openings 42 and 44 are preferably orientated horizontally as compared to previous prior art parallel opening orientation for ease of airflow. The air holes also create more flexibility in the movement of the middle support piece from one side to the other, from concave to convex, once suction has been applied.

Figure 2:
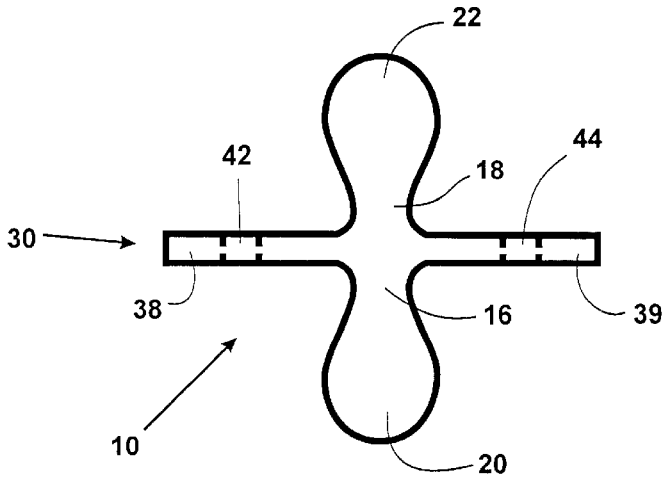
FIG. 2 is a plan view of FIG. 1 with the support member in the neutral position looking in the direction of the arrows along the line 2—2 in FIG. 5.
Figure 3:
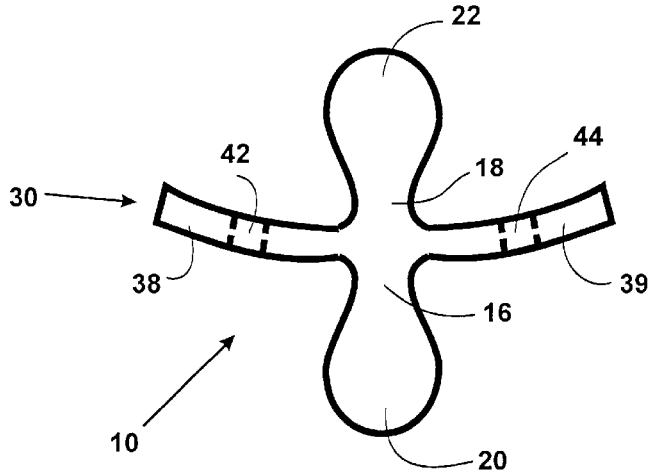
FIG. 3 is a plan view of FIG. 1 with the middle support member in the sucking convex position looking in the direction of the arrows 3—3 in FIG. 6.
Figure 4:
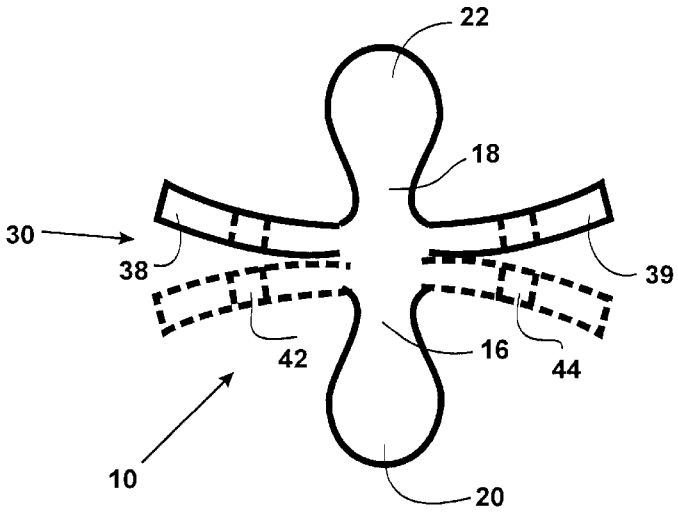
FIG. 4 is a plan view, partly in phantom illustrating the movement of the middle support member from the convex to the concave position.

In use it will be apparent that the pacifier of the present invention is moveable between the neutral position shown in FIG. 2 and the sucking positions shown in FIGS. 3 and 4. The pacifier thus may move from a the neutral position shown in FIG. 2 to a concave position or to a convex position. This is illustrated in phantom in FIG. 4.

Figure 5:
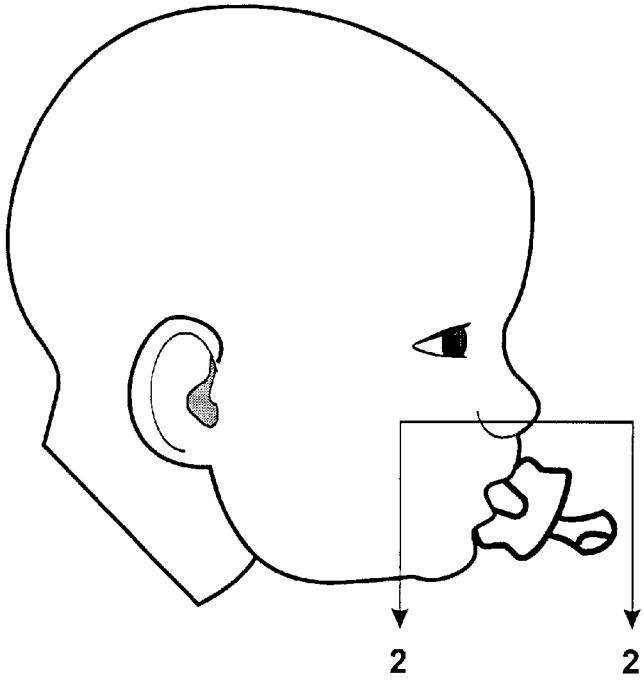
FIG. 5 is a schematic perspective view illustrating the pacifier in the neutral position prior to contact with a sucking baby.
Figure 7:
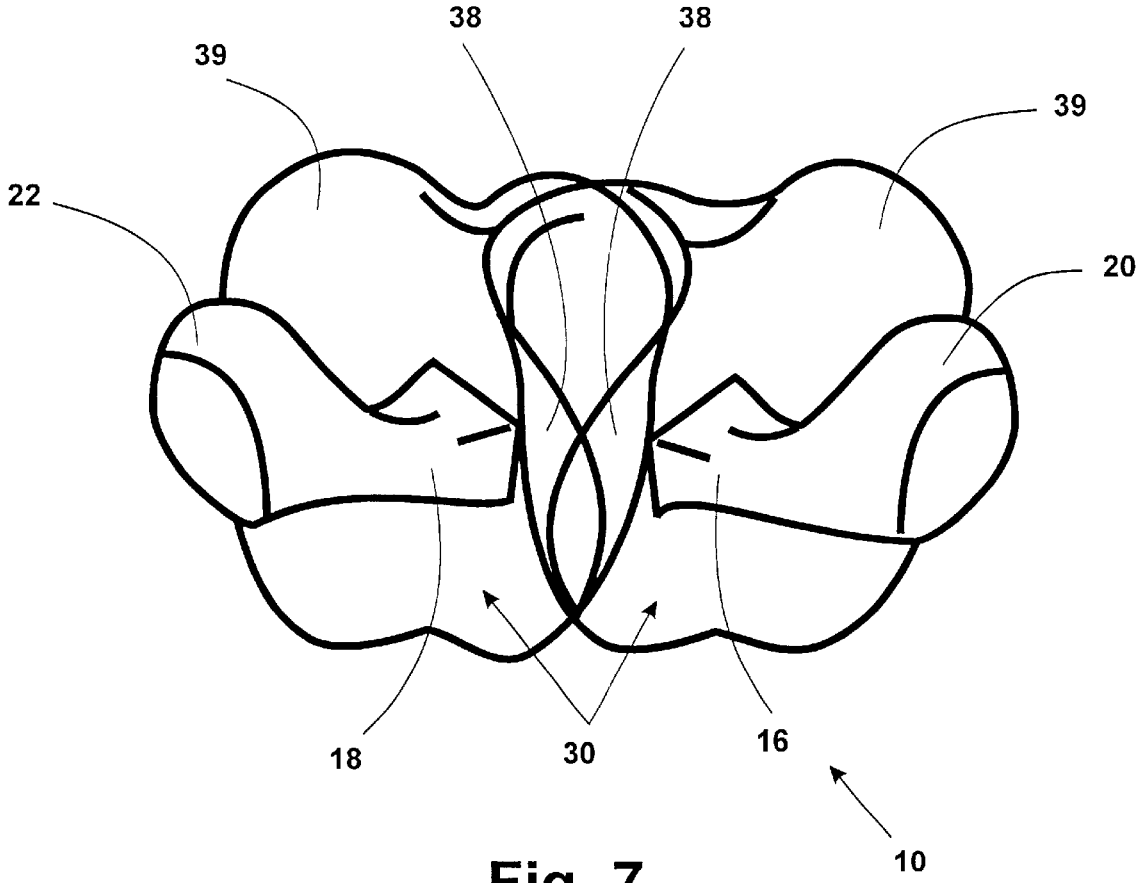
FIG. 7 is a schematic elevation view illustrating the pacifier in the neutral position.

FIGS. 2, 5 and 7 illustrates use of the pacifier in the neutral position prior to sucking by the child.

Figure 6:
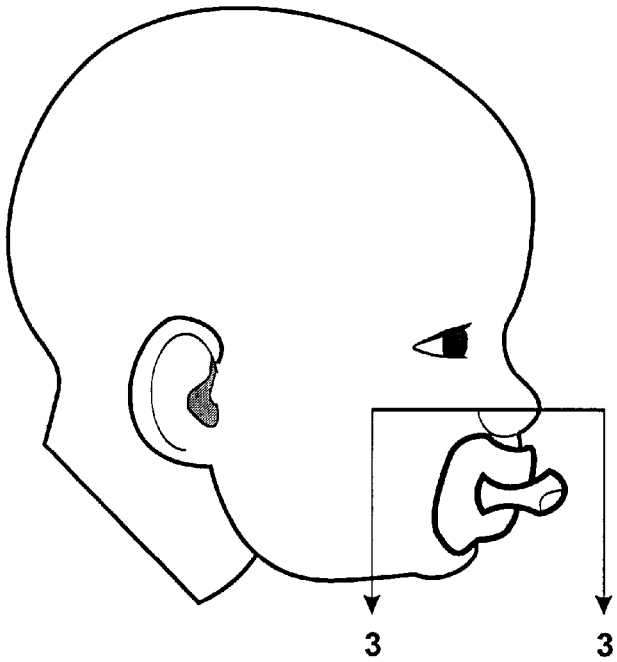
FIG. 6 is a view of the pacifier in the convex position being sucked by the baby.

FIGS. 3 and 6 illustrates use of the pacifier in sucking position by the child in the concave position.

FIG. 4 illustrates use of the pacifier in sucking position by the child in the convex position.

From birth to about four months, a small size pacifier is used.

From about six to about eight months, a medium size pacifier is used.

From about nine months until the baby has outgrown pacifiers, a large size pacifier is used. Determination of specific dimensions is within the skill of the art.

What is claimed is:

1. A double-nipple pacifier comprising:

a first sucking portion including a shank portion and a nipple portion;

a second sucking portion including, a nipple portion and a shank portion;

said shank portions being connected to opposing sides of a middle support portion;

said middle support portion having a pair of outwardly extending ear portions;

wherein said middle support portion is made of elastomeric material and wherein said middle support portion is flexible so as to be moveable between neutral, concave, and convex positions depending upon which nipple portion the baby is sucking on.

2. A pacifier according to claim 1 wherein said middle support portion includes laterally spaced openings for airflow in said ear portions.

3. A pacifier according to claim 2 wherein said openings are elongated and generally perpendicular to said shank portions.

4. A pacifier according to claim 3 wherein said ear portions include a curved portion at the external surface of said ear portions.

5. A pacifier according to claim 1 wherein said pacifier is made of elastomeric material.

6. A pacifier according to claim 5 wherein said elastomeric material is selected from natural rubber, synthetic rubber and mixtures thereof.

* * * * *